FIG. 1
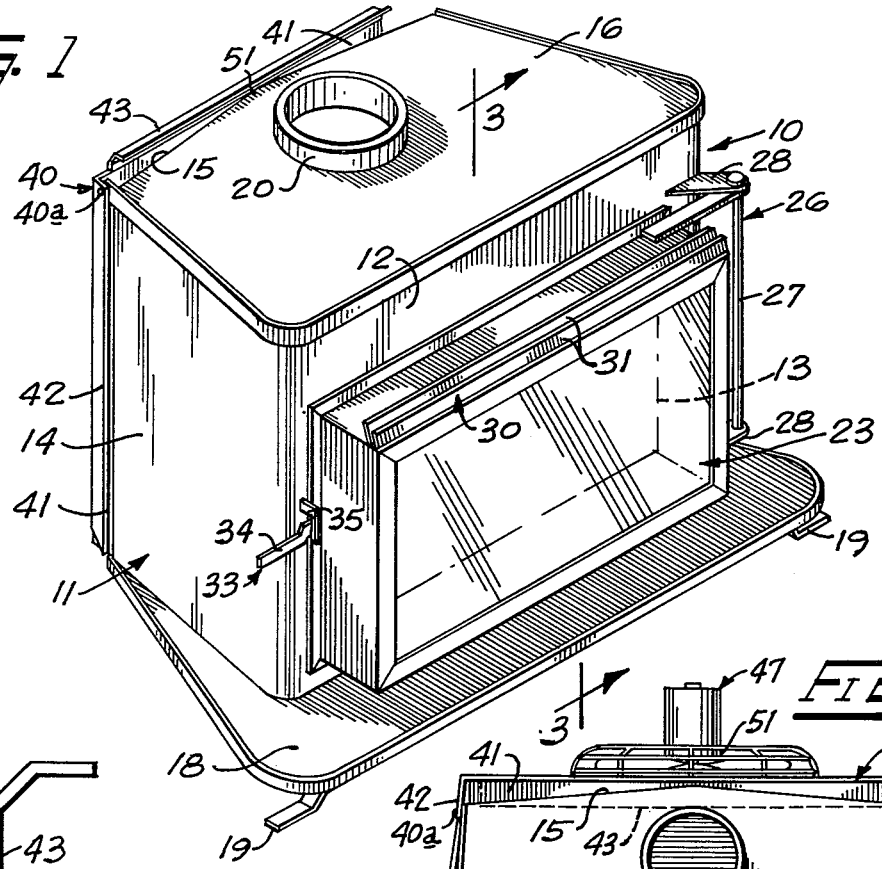
FIG. 2
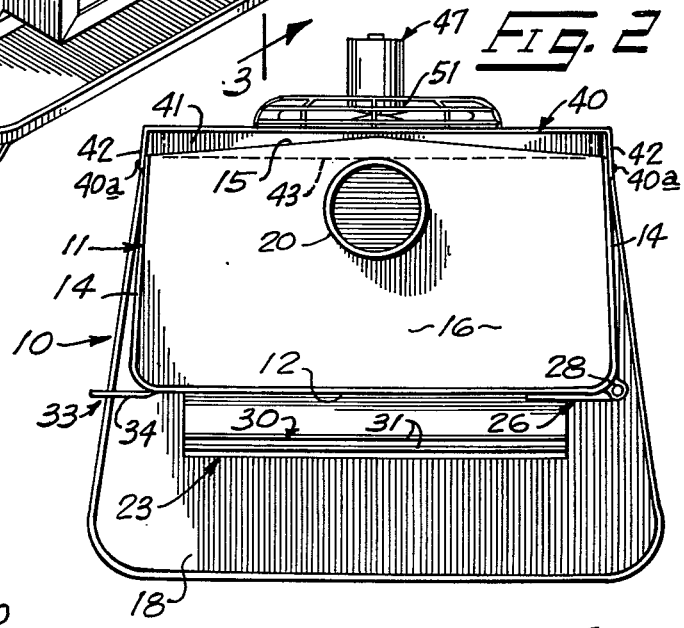
FIG. 5
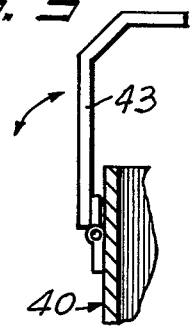
FIG. 3
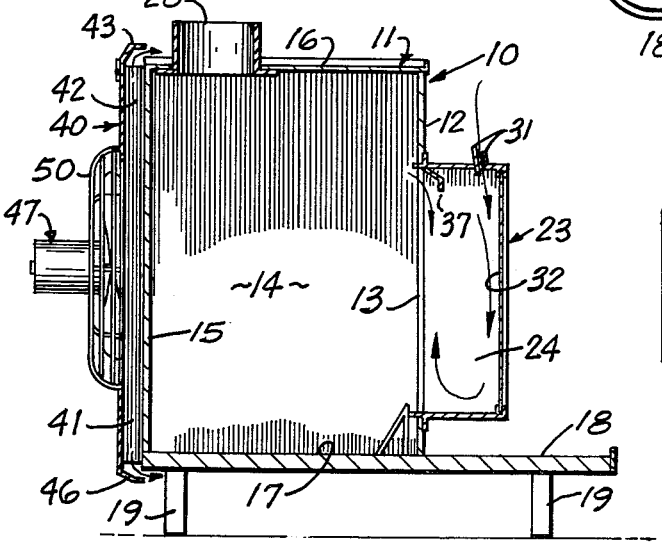
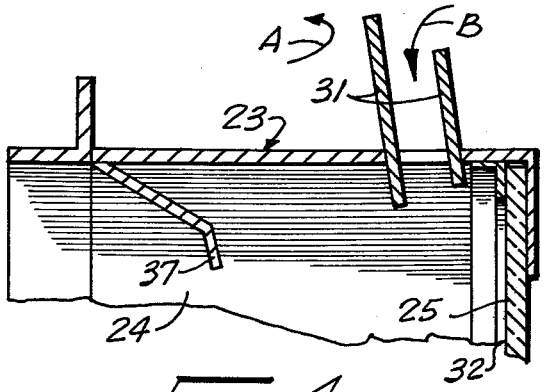
FIG. 4

25
26
31
29
30
32a
25
23
24
32a

30a 25a
26
29
30a
25a
30
32a
23
32a
24

FREESTANDING FIREPLACE AND ROOM HEATER

BACKGROUND OF THE INVENTION

The present invention is related to combined freestanding fireplaces and room heaters that utilize a forced air arrangement for efficiently distributing the heat produced by the unit throughout the surrounding atmosphere.

Fireplaces have long been a source of enjoyment but are very inefficient means of heating an associated room. This characteristic is true both of the permanent built-in fireplace units and the modern freestanding fireplaces. Fixed or stationary fireplaces are probably the most inefficient room heaters since heat from the fire generally can only be projected toward the forward opening thereof. With freestanding fireplaces, the heat may radiate from all sides of the fireplace body. There is still inefficiency because the units generally do not have provision for directing the heated air away from the fireplace body. Instead, it rises to the ceiling and heats only the area directly above the unit itself. Of course the heat will spread gradually throughout the room but by the time the far corners of the room are heated, the area immediately adjacent to the fireplace is usually too hot.

Another problem associated with freestanding fireplaces, especially those having glass door closures, is that the glass doors often become coated with soot and ashes from the fire and must be frequently cleaned. This is a tedious and obviously messy job.

There are forms of fireplace units that are more or less effective in forcing heated air from the fireplace outwardly into the associated room. However, these units are usually bulky and very uncomely.

U.S. Pat. No. 3,171,399 to W. B. Kirgan granted Mar. 2, 1965 discloses a furnace type space heater wherein the area surrounding the firebox is utilized as a plenum chamber. It heats air as it moves downwardly from an intake adjacent the upper surface of the heater to a discharge at a bottom side of the heater. The heater makes use of a blower unit to draw the air through the plenum chamber.

U.S. Pat. No. 1,178,854 to H. C. Keeler granted Apr. 11, 1916 discloses a portable fireplace. This fireplace unit is comprised of a sheet metal formed firebox with a plurality of doors on a front surface of the firebox that are hinged to allow folding of the doors completely away from the front of the fireplace leaving an open fire chamber. The unit includes an inclined deflector above the fire area that deflects smoke forward and subsequently upward and back horizontally to a chimney pipe. This somewhat resembles the smoke trap of ordinary permanent type fireplaces. There is no provision for forcing air over the heated outside surfaces of the unit. The bottom and back sides of the fireplace unit are insulated.

U.S. Pat. No. 1,944,626 to E. A. Allbert granted Jan. 23, 1934 discloses a combined heater and fireplace. This is a freestanding unit that includes a double door arrangement. A first, outer door, is formed of sheet metal and is retractable to a stored position above the firebox. When the outer door is in this position an inner, glass door is exposed to allow relatively full view of the fire within. There is no provision for circulating the air outside the firebox, nor is there any special provision for keeping the glass viewing pane clean and protected from soot and ashes from the fire within.

U.S. Pat. No. 2,808,823 to W. J. Snyder et al granted Oct. 8, 1957 discloses a space heater. Again, this unit is intended primarily as a furnace (like the Kirgan heater). A fan unit is attached at the rear of the heater to direct air inwardly and upward over an enclosed firebox. Since the firebox is completely enclosed within a sheet metal housing except for a louvered area at the top, the heated air is allowed to move only in an upward and outward direction. This unit is provided in the form of a stove or furnace arrangement wherein the fire chamber is completely enclosed and is not visible from the outside when the firebox door is in a closed position.

It is a first object of the present invention to provide a freestanding fireplace and room heater combination that is both pleasing in appearance and is a highly functional heating unit.

A further object is to provide such a combined heating and freestanding fireplace unit that includes a removable glass pane in the door structure with draft means associated therewith for continuously cleaning or preventing build-up of material on the inside surface of the glass when the unit is in operation.

Another object is to provide such a fireplace and heating unit that includes a door structure that may be moved completely out of the way of the forward opening in order to provide free access to the firebox interior.

Another object is to provide such a fireplace and heating unit wherein the glass pane is interchangeable with a metal panel so the unit can be converted from a decorative fireplace to a fully functional stove.

A still further object is to provide a fireplace and heating unit wherein air may be forced across the outside radiating surfaces of the fireplace unit in order to quickly heat an associated room.

These and still further objects and advantages will become apparent upon reading the following detailed description which, taken with the accompanying drawings, disclose a preferred form of my invention. However, it is to be noted that the drawings and following description merely set forth an example of a preferred form of my invention and by no means are intended to restrict the scope of my invention to the particular details shown herein. Only the claims to be found at the end of this specification set forth the scope of what I claim to be my invention.

BRIEF DESCRIPTION OF THE DRAWINGS

A preferred form of the present invention is illustrated in the accompanying drawings in which:

FIG. 1 is a pictorial view of the present fireplace and room heater;

FIG. 2 is a top plan view;

FIG. 3 is a cross-sectional view taken substantially along line 3—3 in FIG. 1;

FIG. 4 is an enlarged sectional view of elements of the door assembly;

FIG. 5 is a fragmentary enlarged sectional view;

Figure 6:
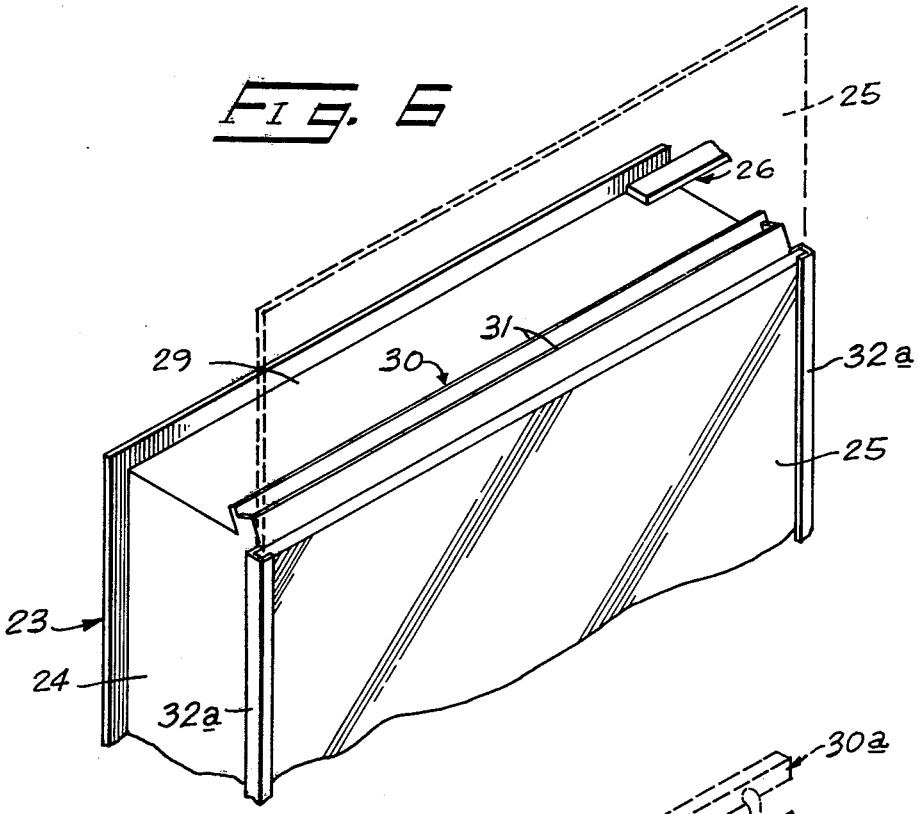
FIG. 6 is a fragmentary enlarged pictorial view of a door for my fireplace unit having a removable glass pane.
Figure 7:
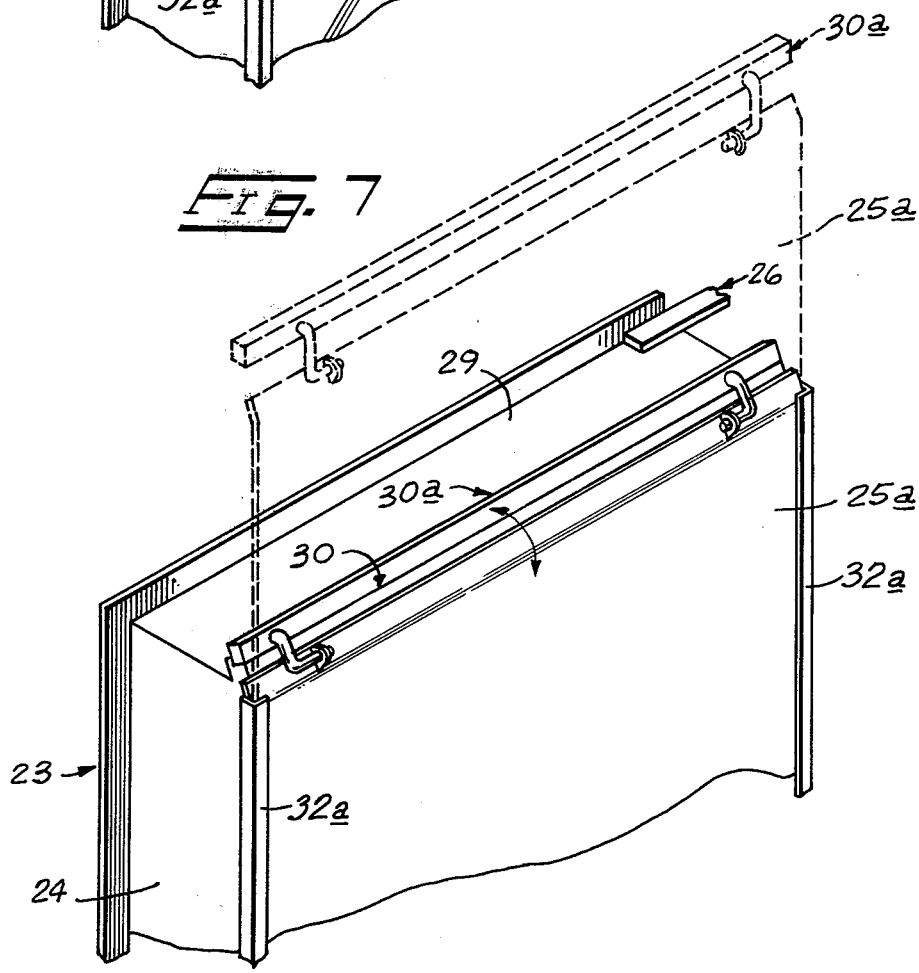
FIG. 7 is a fragmentary pictorial view of the door shown in FIG. 6 only with a metal panel in place of the glass pane.

space 41 will be guided in an upward direction, or when the deflector flap is in an operative position (FIG. 5), the air will be directed in a horizontal plane over the top surface 16 of the firebox. The flap 43 may be utilized as a control to regulate the amount of air flowing over the heated surfaces of the firebox and therefore effectively vary the amount of forwardly radiating heat.

The baffle plate 40 also includes a horizontal bottom deflector 46 (FIG. 3) that projects downward and forward below the firebox bottom 17. Deflector 46 is forwardly inclined to direct air from the air space 41 forwardly along the bottom of the firebox. Thus, it is understood that air may pass or be forced to pass by blower means 47 over substantially all the heated surfaces of firebox 11 with the exception of front 12.

The blower means 47 may be a blade type fan and motor combination as shown in the drawings or a squirrel cage type fan may also be effectively used. The blower means 47 is mounted to baffle plate 40 within an appropriate aperture 50 formed therethrough. This aperture is located centrally on the plate 40 such that air is received by the fan and directed against the back of the heater unit 10. The back 15 is preferably somewhat "wedge" shaped with forward diverging sides leading to a central edge 51. The forced air will be evenly divided at the edge 51 of the wedge configuration and diverted in opposite horizontal directions to fins 42 as well as up and downwardly toward the appropriate deflector flap 43, or bottom deflector 46.

The blower means 47 may be operated in response to a thermostatic control or, more simply, may be operated from an appropriate manual switch to function at the will of the operator.

It is understood that various changes and modifications may be made in view of the drawings and description of my invention as made above. However, the above description and attached drawings are not intended in any way to place restrictions upon the scope of my invention. Only the following claims are to be taken as definitions and limitations upon the scope of what I define as my invention.

What I claim is:

1. A freestanding fireplace and room heater, comprising:

a firebox having a front opening and a top opening;

said top opening being adapted to receive a chimney pipe;

said firebox having a flat top surface and upright sidewalls joined by upright front and back walls;

a door;

hinge means mounting the door to the front wall of the firebox for pivotal movement about a vertical axis between a closed position completely covering the front opening and an open position adjacent one sidewall of the firebox;

latch means for tightly securing the door to the firebox in the closed position;

a baffle plate mounted in spaced relation to the back wall of the firebox to create an open air space across the back of the firebox;

fins on outside edges of the baffle plate that extend fowardly to deflect air forwardly over the firebox;

blower means on the baffle for forcing air through the air space to be heated by the firebox and exhausted in a forward direction over the firebox;

wherein the door includes a door frame supporting a pane of glass and wherein the door frame is situated between the glass pane and front firebox wall such that in the closed position, the pane is spaced forwardly of the front firebox wall; and wherein the door includes a draft means along an upper horizontal surface thereof for receiving outside air and directing it along an inside surface of the glass pane.

2. The heater as set out by claim 1 wherein the draft means is comprised of louvers formed within the door frame.

3. The heater as set out by claim 1 wherein the firebox includes a forward and downward projecting gas deflecting baffle located at an upper horizontal edge of the front opening when the door is at the closed position.

4. The heater as set out by claim 1 wherein the hinge means is located adjacent one side wall to facilitate swinging movement of the door to an open position substantially flush with the adjacent side wall.

5. The heater as set out by claim 1 further comprising a hinged deflector flap at a top edge of the baffle plate that is movable to an operative position to deflect air across the firebox top surface and to an inoperative position; wherein the air is allowed to exit in an upward direction.

6. The heater as set out by claim 1 wherein the firebox stands on legs and the baffle plate includes a bottom deflector extending forwardly below the firebox and adjacent the bottom of the back wall to direct air forwardly across the firebox bottom.

7. The heater as set out by claim 1 further comprising a hearth projecting forwardly of the firebox and door when the door is in the closed position.

8. The heater as defined in claim 1 wherein the hinge means enables the door to be pivoted more than 270° from the closed position and the open position.

9. The heater as defined in claim 1 wherein the door frame includes upwardly open upright guideways removably receiving the glass pane such that the glass pane may be selectively removed from the door; and further comprises a metal panel that may be inserted between the guideways in place of the glass pane.

10. The heater as defined in claim 1 further comprising a draft control for selectively adjusting the amount of airflow through the draft means.

* * * * *

United States Patent [19]

Cote

[11] 4,121,561

[45] Oct. 24, 1978

[54] STOVE

[76] Inventor: Richard G. Cote, R.F.D. #2, Concord, N.H. 03301

[21] Appl. No.: 781,782

[22] Filed: Mar. 28, 1977

[51] Int. Cl.[2] ..... F24B 3/00

[52] U.S. Cl. ..... 126/65; 29/463; 113/116 EE; 220/DIG. 25

[58] Field of Search ..... 220/DIG. 25; 126/62, 126/64, 65, 58, 61, 83; 110/97 R, 326; 29/463; 113/116 EE

[56] References Cited

U.S. PATENT DOCUMENTS

| | | | |
|---|---|---|---|
| 87,519 | 3/1869 | Spaulding | 126/61 |
| 2,420,184 | 5/1947 | Mekelburg | 220/DIG. 25 |
| 2,421,225 | 5/1947 | Stensgaard | 220/DIG. 25 |
| 2,483,476 | 10/1949 | Ryden | 110/97 R |
| 2,741,390 | 4/1956 | Moore | 220/DIG. 25 |
| 3,509,867 | 5/1970 | Brosens et al. | 110/97 R X |
| 3,553,823 | 1/1971 | Alfredsson | 29/463 X |
| 4,002,287 | 1/1977 | Saveth | 220/DIG. 25 |

*Primary Examiner*—William E. Wayner
*Assistant Examiner*—William E. Tapolcai, Jr
*Attorney, Agent, or Firm*—Thomas N. Tarrant

[57] ABSTRACT

A box stove made essentially of two pieces of sheet metal bent into the forms of interlocking "U"s and assembled together. The stove containing a roof-shaped baffle below the flue exit.

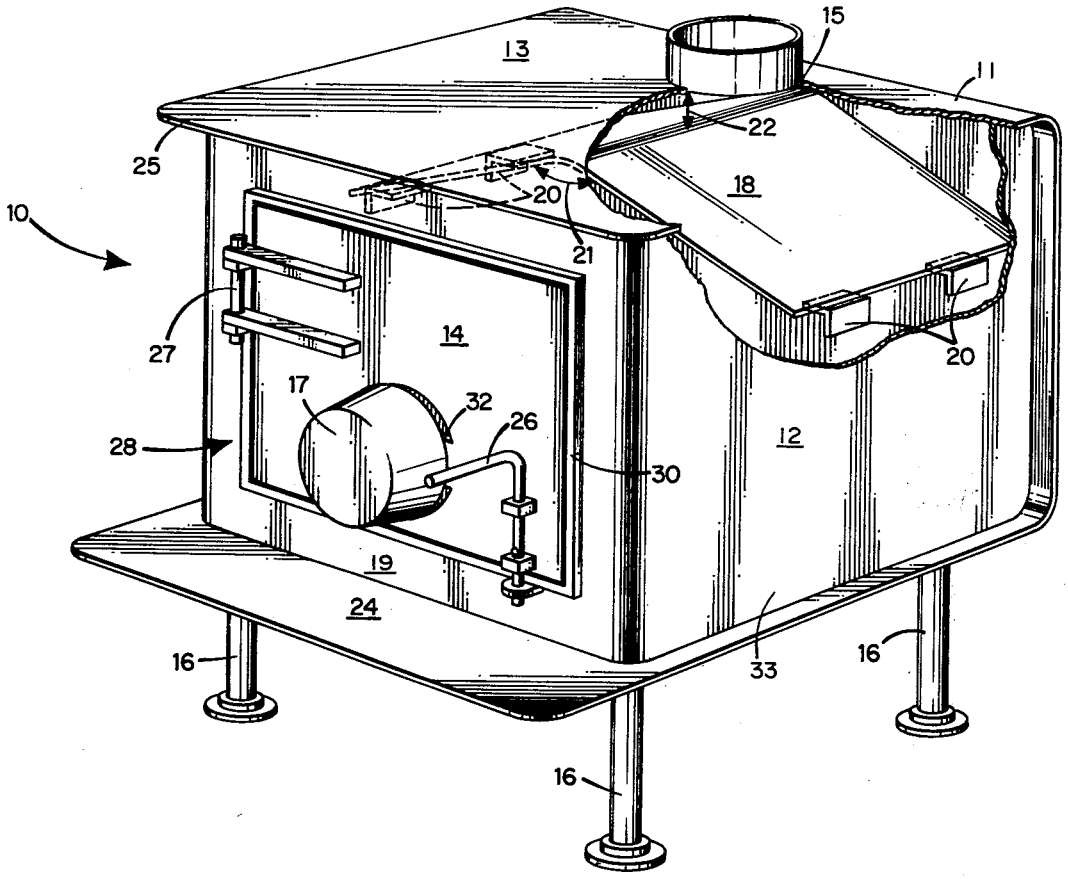

7 Claims, 3 Drawing Figures